United States Patent [19]

Smith, III

[11] 4,398,086

[45] Aug. 9, 1983

[54] GAME-CALCULATOR HAVING SLIDING MASK

[75] Inventor: Jay Smith, III, Pacific Palisades, Calif.

[73] Assignee: Smith Engineering, Santa Monica, Calif.

[21] Appl. No.: 337,229

[22] Filed: Jan. 6, 1982

[51] Int. Cl.[3] ..... G06C 7/02

[52] U.S. Cl. ..... 235/145 R; 235/419; 340/365 VL; 434/229; 364/705; 364/410

[58] Field of Search ..... 235/419, 145 R; 340/365 VL; 434/227, 228, 229; 377/5; 364/410, 705

[56] References Cited

U.S. PATENT DOCUMENTS 4,336,530 6/1982 Kolke ..... 340/365 VL

*Primary Examiner*—Harold I. Pitts

*Attorney, Agent, or Firm*—Jackson, Jones & Price

[57] ABSTRACT

A game-calculator having a single housing for a hand-held calculator and an electronic game each sharing the same display, with a sliding mask to alternatively cover in a first or second position either the calculator keyboard input keys, or both the game input keys and that portion of the display panel not used to display the calculator functions, with the slide also serving to position a switch which is coupled to the programmed data processor, responsive to movement of the slide from the first position to the second position, or vice versa.

8 Claims, 4 Drawing Figures

FIG. 1
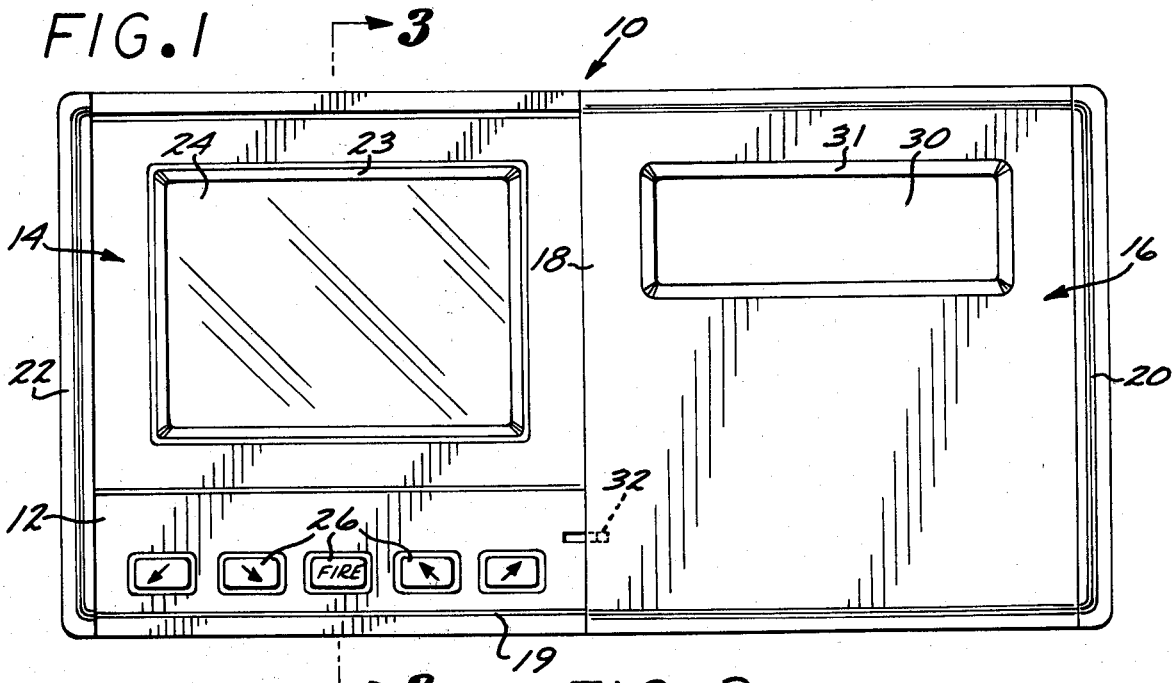
FIG. 2
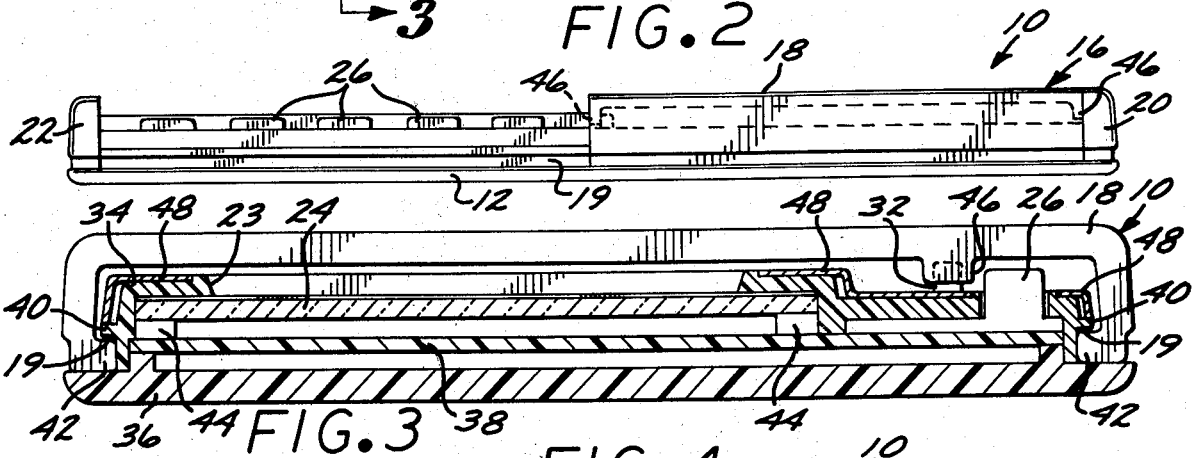
FIG. 3
FIG. 4
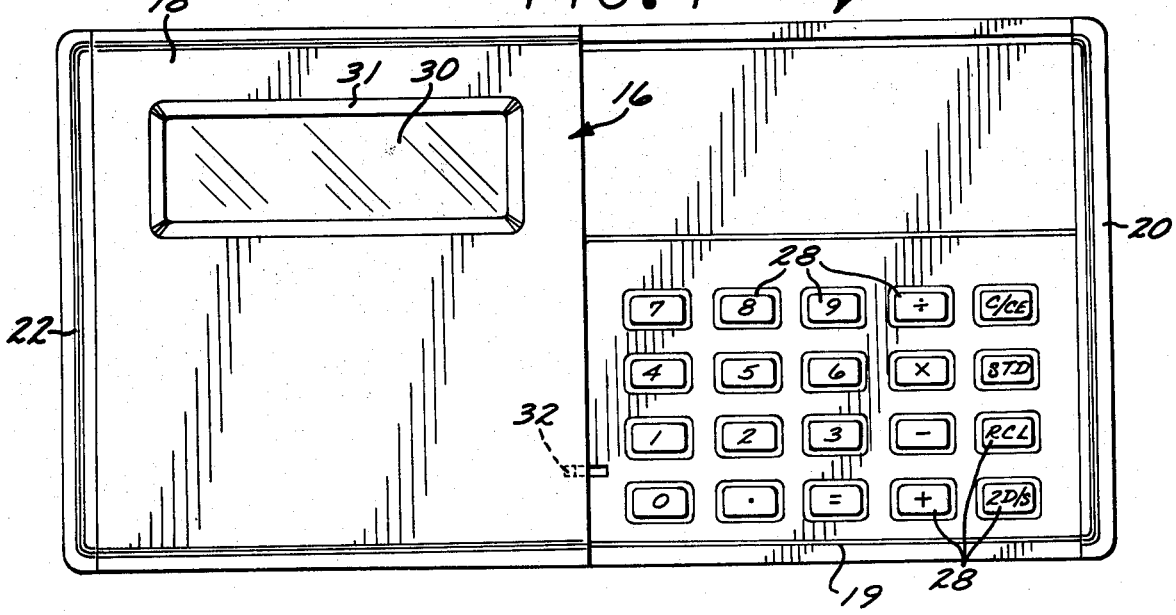

GAME-CALCULATOR HAVING SLIDING MASK

BACKGROUND AND SUMMARY OF THE INVENTION

This invention relates to a novel hand-held calculator and electronic game sharing the same display. More particularly, this invention relates to a hand-held calculator having a programmed data processor for controlling the calculator functions and a display panel. The display panel displays the calculator functions, as is commonly known in the hand-held calculator art, and also displays an electronic game in response to a game in response to a game program stored in the programmed data processor and player controlled game inputs. The calculator portion is at one location on the housing of the game-calculator and the display panel and game inputs are on another portion of the game-calculator. The game-calculator has a sliding mask to cover the calculator portion in a first position of the mask and cover the game control inputs and that portion of the display panel not needed for display of the calculator functions, when the sliding mask is in a second position of the sliding mask.

In the past it has been common to incorporate hand-held calculators into a rectangular, relatively thin housing, having a plurality of calculator inputs in the form of, e.g., a keyboard of input buttons for controlling the calculator functions and also having on the housing a display panel, e.g., a liquid crystal diode display to display the calculator functions. Such hand-held calculators are commonly known on the market, e.g., those designed to be carried in a note holder or checkbook, of the kind manufactured by Sharp, Model No. EL-8149; Unisonic, Model Nos. LC-223CK and LC-224CK; and Casio, Model No. LC-78G.

It has also been known to use a programmed data-processor, e.g., a microprocessor, or other suitable large scale integrated circuit data processor, for controlling a liquid crystal diode display, having appropriate selectively illuminated display portions, for the purpose of playing an arcade-type game. This is accomplished in response to a stored program and player input through one or more of the plurality of game inputs in the form of, e.g., push buttons. Such an arcade game incorporated into, e.g., a watch housing is shown in a copending application assigned to the assignee of the present application and having a Ser. No. 270,314, filed on June 4, 1981 in which the present applicant is a co-inventor, the disclosure of which is hereby incorporated by reference. In that watch, the upper portion of the display forms a numerical display for the watch functions, e.g., date, time, etc., and when the game watch is in the game playing mode, is employed to display game-related information, e.g., the game selected, score, and level of difficulty. In the game playing mode the remainder of the display has segments which are selectively illuminated to represent the play of the game.

With the calculators of the kind described above, there is generally no alternative function carried out in response to operator input, through the use of the calculator keyboard input buttons, other than functioning as a calculator. With the game watch of the kind described above, the input buttons are used in the watch mode to control watch functions, e.g., setting the time and date and selecting the display, e.g., time, date, or seconds. Additionally, in the game display mode, the input buttons are used, e.g., in selecting the game and controlling the player inputs to the programmed data processor in response to the manner in which the game is played and the existing display on the display panel.

With the incorporation in the present invention of a calculator and an electronic game in a single hand-held unit, for the convenience of the operator and also for the projection of the game-calculator, the need exists to be able to selectively shield the input buttons for, respectively, the calculator and game input functions, when it is desired operate in, respectively, the game or calculator mode. For example, when the game-calculator of the present invention is to be used in the game mode, the operator might become confused as to which button inputs were for game operation and which button inputs were for the, then inactive, calculator mode. Further, since the game is hand-held, the operator might unduly manipulate the calculator input buttons in grasping the game-calculators, which would not effect the game display, but could result in an inordinate wear and tear on the calculator input keyboard. Further, when the game-calculator is used in the game mode, the entire game display panel is exposed. This display panel, being larger in surface area than a typical calculator display panel, is more susceptible to damage due to inadvertent impact on the surface of the panel. It is thus desirable when the game-calculator is used in the calculator mode, to protect as much as possible of the surface area of the display panel from impact, while still being able to display the calculator functions.

The problems enumerated in the foregoing are not intended to be exhaustive, but, rather, among many which tend to impare the effectiveness of previously known hand-held calculators or electronic games. Other noteworthy problems may also exist; however, those presented above should be sufficient to demonstrate that hand-held calculators and electronic games appearing in the art would not be altogether satisfactory if combined into a single hand-held unit.

Recognizing the need for an improvement in hand-held calculators or electronic games where combined into a single housing, it is therefore a general feature of the present invention to provide a novel game-calculator housed in a single unit, which minimizes or reduces the problems of the type previously noted. One feature of the present invention is a sliding mask which slideably engages the housing containing the calculator input keyboard and the display panel and game input buttons, and which selectively covers either the calculator input keyboard or the display panel and game input buttons. The sliding mask also has an opening therein which uncovers a portion of the display panel sufficient to allow display of the calculator functions when the sliding mask is positioned over the portion of the game-calculator housing containing the display panel, but not uncovering any of the calculator inputs on the calculator input keyboard when in the position to cover the calculator input keyboard.

Examples of the more important features of this invention has been given rather broadly in order that the detailed description thereof that follows may be better understood, and in order that the contribution to the art may be better appreciated. There are, of course, additional features of the invention that will be described hereinafter and which will also form the subject of the appended claims. These additional features and advantages of the present invention will become apparent with reference to the following detailed description of a preferred embodiment thereof, in connection with the accompanying drawings, wherein like reference numerals have been applied to like elements, in which:

BRIEF DESCRIPTION OF THE DRAWINGS

FIG. 1 depicts a plan view of the game-calculator of the present invention;

FIG. 2 shows a side elevational view of the game-calculator of FIG. 1;

FIG. 3 shows a cross-sectional view of the game-calculator of FIG. 1, taken along section line 3—3 of FIG. 1;

FIG. 4 shows a plan view of the game-calculator of FIG. 1 with the slide according to the present invention in an alternative position to that shown in FIG. 1.

DETAILED DESCRIPTION OF A PREFERRED EMBODIMENT

Turning first to FIG. 1, a preferred embodiment of the present invention is shown. The preferred embodiment of game-calculator 10 is shown to have a housing 12 which has a game end 14 and a calculator end 16. The housing 12 has slideably attached thereto a slide member 18, which is slideably engaged in a groove 19 (more particularly shown in FIGS. 2 and 3) on opposing longitudinal sides of the housing 12. At one end of the housing 12 is a ridge 20 and at the other end of the housing 12 is a ridge 22, which, respectively, form stop members preventing the slide member 18 from moving any further in the grooves 19 at the respective ends of the housing 12.

Contained within the game end 14 of the housing 12 is an opening defined by a beveled frame 23, which forms an opening for a display panel 24. The display panel 24 may be of any suitable kind, e.g., a liquid crystal diode of the kind described in the above-referenced patent application. Also at the game end 14 of the housing 12, and below the display panel 24, are a plurality of game inputs, e.g., push buttons 26. These are used by the operator of the game-calculator to, for example, select the game to be played and control the play of the game through selective input to the programmed data processor (contained on circuitry not shown, within the housing 12) in response to the game display on the display panel 24 and the manner of playing the game, as is described, for example, in the above-referenced co-pending patent application. It will be understood by those skilled in the art that the particular display and the types of games referred to in that patent application are by no means limiting herein and the present invention can be suitably used with other panels having various types of games capable of being displayed thereon.

At the calculator end 16 of the housing 12 are positioned a plurality of calculator inputs, e.g., push buttons 28 which are arranged to form a calculator input keyboard as is well known in the art of hand-held calculators. When the game-calculator 10 is in the calculator mode, the push buttons 28 of the calculator keyboard are enabled and used to control the calculator function carried out by the programmed data processor contained on the above-noted circuitry (not shown) contained within the housing 12. The same programmed data processor controls both the calculator functions and game functions according to whether the game-calculator is in the game mode or calculator mode. The numerical portion of the display panel 24, as it is described, for example, in the above-noted co-pending patent application (with the exception only of the number of digits which are capable of representation by the display), serves to display the calculator functions as is well known in the art of hand-held calculators. As shown in FIG. 1, the slide member 18 has an opening 30 therein defined by a beveled frame 31, which is of sufficient size to leave uncovered the portions of the display panel 24 containing the numerical display, when the slide 18 is moved to a position to otherwise cover the remainder of the display panel 24 and the game input buttons 26, as shown in FIG. 4.

A slide switch 32 contained on the housing 12 is operated in response to movement of the slide member 18 from a first position, in which it covers either the game end 14 or the calculator end 16, to a second position, in which it covers the other end, i.e., respectively, the calculator end 16 or the game end 14. The two positions are shown in FIGS. 1 and 4.

Turning now to FIG. 3, it is shown that the housing 12 is formed by a top 34 and a bottom 36, which may be formed out of any suitable material, e.g., molded plastic, and attached to each other in any suitable fashion, for example, by adhesive fastening. Contained within the interior of the housing 12, formed by the joining of the top 34 to the bottom 36, is a printed circuit board 38 upon which rests the display panel 24 with electrical contact between the printed circuit board 38 and display panel 24 being illustrated, for example, by the contacts 44. The makeup of the LCD display panel 24 to display various games, and the numerical calculator function display, including the necessary contact with printed circuit board and the program data processor to accomplish, e.g., multiplexing of the various segments of the display panel 24, is explained in more detail, and by way of example, in the above-noted co-pending patent application. The numerical display referred to therein is there used, however, alternatively to display game related numbers and watch function related numbers, as opposed to calculator function related numbers in the present invention. The top 34 has a thin metal protective cover 48 attached thereto, which may, for example, be made of aluminum.

The manner in which the slide member 18 slideably engages the housing 12 is more fully illustrated in the cross-sectional view of FIG. 3. A lip 40 extends out from the top 34 longitudinally along each of the two opposing sides of the housing 12, and together with the bottom 36 forms a groove 19 into which a foot 40 on the slide member 18 extends. The slide member 18 is generally "U" shaped in cross-section, and a foot 42 extends from each of the opposing terminal ends of the "U" shaped cross-section, and each extends longitudinally along the length of the respective slide member 18.

A pair of protrusions 46 extend from each transverse end of the slide 18 towards the top 34, and each is positioned to contact the switch 32 as the slide member 18 moves in the grooves 19. Each protrusion 46 is positioned on the slide member 18 such that when the slide member 18 is in the position shown in FIG. 1, the protrusion 46 on the left hand end of slide 18, looking down on the view of FIG. 1, has engaged the slide switch 32 and moved the slide switch 32 sufficiently to place the switch 32 in a first position. In the first position, shown in FIG. 1, the switch 32 is in a position to indicate to the programmed data processor that the game functions are to be enabled and the calculator functions disabled. As the slide 18 is moved to the left from the position shown in FIG. 1, the protrusion 46 on the right hand end of the slide 18 engages the switch 32, moving the switch 32 to a second position to enable the calculator functions of the game-calculator, and disable the game functions.

SUMMARY OF THE ADVANTAGES AND OPERATION OF THE INVENTION

In operation the game-calculator 10 of the present invention is either in the calculator mode or the game mode. In the calculator mode the slide member 18 covers the game input buttons 26 and most of the LCD 24, except for the portion thereof used for numerical display in response to the calculator functions of the game-calculator 10. In the game mode, the slide member 18 covers the calculator input keyboard formed by input buttons 28. Thus in the former case the LCD is protected to as much an extent as possible and inadvertent depression of the game key buttons 26 is prevented. In the latter case the calculator keyboard keys 28 are prevented from being inadvertently depressed, which saves wear and tear on them and prevents operator confusion as to which keys control the game functions.

The foregoing description of the invention and its advantages has been made to illustrate a preferred embodiment thereof and not by way of limitation of the claims to a particular embodiment. Those skilled in the art will appreciate that many modifications within the skill of the art could be made without departing from the spirit and scope of the invention. By way of example only, the slide switch could be replaced with a switch which is operated by depressing the switch and the protrusions could be replaced with a single protrusion which passes over and depresses the switch as the slide member moves from its first position to its second position, or vice-versa. Also, the shoes in the grooves need not be continuous along the longitudinal lengths of either longitudinal side of the slide member in order to perform the function of slidelingly engaging the game-calculator. Other forms and modifications of the invention will be apparent from the above description to those skilled in the art, and the appended claims are intended to cover such forms and modifications.

What is claimed is:

1. A game-calculator having a programmed data processor for controlling the calculator and the game functions, comprising:

a housing having a game end and a calculator end;

the calculator end having a plurality of calculator inputs;

the game end having a display panel and a plurality of game inputs;

a slide member, slideably mounted on the housing and of a size sufficieant to cover the plurality of calculator inputs when positioned at the calculator end, and to cover the display panel and the plurality of game inputs when positioned at the game end;

an opening in the slide, positioned to expose the portion of the display panel employed in displaying the operation of the game-calculator as a calculator.

2. The apparatus of claim 1 further comprising:

a switch, selectively activated by the position of the slide member, the switch being coupled to an input to the data processor to thereby activate the calculator functions or the game functions in response to the position of the switch.

3. The apparatus of claim 1 wherein:

the housing is formed with a longitudinally extending groove on opposed sides thereof; and the slide has a generally "U" shaped cross-section with a pair of opposed longitudinally extending feet at the terminal ends of the "U" shaped cross-sections, which feet slideably engage a respective one of the grooves.

4. The apparatus of claim 2 wherein:

the housing is formed with a longitudinally extending groove on opposed sides therof; and the slide has a generally "U" shaped cross-section with a pair of opposed longitudinally extending feet at the terminal ends of the "U" shaped cross-sections, which feet slideably engage a respective one of the grooves.

5. The apparatus of claim 3 wherein:

the slide member has a pair of protrusions; and the switch is a slide switch operated by a respective one of the protrusions engaging the switch when the slide member is moved from one of the game end and calculator end to the other.

6. The apparatus of claim 4 wherein:

the slide member has a pair of protrusions; and the switch is a slide switch operated by a respective one of the protrusions engaging the switch when the slide member is moved from one of the game end and calculator end to the other.

7. The apparatus of claims 5 or 6 wherein the switch is coupled to a single programmed data processor and the program for the game functions is employed when the switch is in one of the first and the second positions and the program for the calculator functions is enabled when the switch is in the other of the first and the second positions.

8. A game-calculator having a programmed data processor for controlling the calculator and the game functions, comprising;

a housing having a game portion and a calculator portion;

the calculator portion having a plurality of calculator inputs;

a masking means for selectively covering the plurality of calculator inputs when in a first position and the display panel and the plurality of game inputs when in a second position, the masking means having an opening therein for exposing that portion of the display panel employed in displaying calculator functions of the game calculator when the masking means is in the second position.

* * * * *